United States Patent [19]

Kuo

[11] 4,436,037

[45] Mar. 13, 1984

[54] CONTINUOUS IGNITION SOURCE FOR CONTROLLED DISPOSAL OF COMBUSTIBLE POLYMER WASTE IN A FLUIDIZED BED REACTOR

[75] Inventor: Hong-Hsiang Kuo, Troy, Mich.

[73] Assignee: General Motors Corporation, Detroit, Mich.

[21] Appl. No.: 370,457

[22] Filed: Apr. 21, 1982

[51] Int. Cl.[3] ..... F23G 5/00; F23G 7/00

[52] U.S. Cl. ..... 110/245; 110/346

[58] Field of Search ..... 110/245, 237, 346

[56] References Cited

U.S. PATENT DOCUMENTS

| | | | |
|---|---|---|---|
| 3,888,194 | 6/1975 | Kishigami et al. | 110/245 |
| 3,907,674 | 9/1975 | Roberts et al. | 110/245 X |
| 4,177,742 | 12/1979 | Uemura et al. | 110/346 |
| 4,308,806 | 1/1982 | Uemura et al. | 110/245 X |

*Primary Examiner*—Edward G. Favors

*Attorney, Agent, or Firm*—Elizabeth F. Harasek

[57] ABSTRACT

This invention incorporates a point ignition source in a fluidized bed reactor for burning polymeric waste materials. The source is operated at a temperature above the combustion temperature of the waste to continuously ignite the polymer burning reaction. Its use provides for improved safety and uniform operation of such fluidized bed reactors.

4 Claims, 6 Drawing Figures

CONTINUOUS IGNITION SOURCE FOR CONTROLLED DISPOSAL OF COMBUSTIBLE POLYMER WASTE IN A FLUIDIZED BED REACTOR

This invention relates to an apparatus and method for continuously igniting polymeric waste materials burned in a fluidized bed reactor. Use of the ignition means provides for improved safety and uniform operation of the reactor.

BACKGROUND

Heretofore, non-reclaimable thermoplastic polymeric scrap materials have, for the most part, been disposed of as land fill. As the availability of land fill sites diminishes, the cost of plastic waste disposal in this manner increases.

Polymer waste is generated in many ways. For example, a great amount of thermoplastic paint sludge is collected from paint spray booths. Overspray is first flocculated in a water cascade and then collected as sludge. The sludge is dried and disposed of in sealed containers. Other sources of polymer waste are pure or highly filled thermoplastic injection or compression molded compositions. Molding materials with both thermoplastic and thermosetting constituents are common because such materials cannot be readily reprocessed.

It is well known that most polymers can be burned, and that the burning reaction produces a substantial amount of heat energy. Thus, incineration has been considered as an alternative to solid waste disposal. Incinerating thermoplastics, however, presents a number of serious problems. For example, in conventional incinerators, thermoplastic polymers have a tendency to melt. The molten material inhibits uniform combustion which may cause excess smoke production, incomplete incineration and potentially explosive gases. Moreover, thermoplastic waste materials have a wide range of heating values. For example, a paint sludge having a high heating value might produce elevated temperatures that could damage a conventional incinerator. If the heating value of a paint sludge is low, the sludge may not burn continuously or completely.

In my search for alternative methods of burning polymer scrap, consideration was given to the use of fluidized bed incinerators. However, conventional fluidized bed incinerators used to burn coal, paper, wood and other such materials are not suitable for incinerating all polymers, particularly thermoplastics. Thermoplastics melt and clog the fluidized bed. Moreover, conventional feeding systems for coal and other nonmeltable fuels are not adaptable to feeding meltable plastic scrap materials. Further, in conventional fluidized beds the burning reaction of thermoplastics tends to be self extinguishing, i.e., combustion with oxygen cannot be fully sustained within the bed. This may lead to a high concentration of volatile polymer by-products within the reactor and incumbent danger of explosion.

By way of definition, the terms incineration and burning herein refer to the thermal degradation of reaction of polymers in the presence of enough oxygen to support combustion of all burnable constituents at suitable elevated temperatures. Pyrolysis refers to the degradation reaction of such polymers at elevated temperatures in an oxygen deficient atmosphere.

OBJECTS

Accordingly it is an object of the invention to provide a method and apparatus for burning thermoplastic waste material in a fluidized bed reactor to reduce its bulk and recover heat energy. A more particular object is to provide a novel fluidized bed reactor which is adapted to incinerate polymer containing particles, particularly thermoplastics, in a continuous, self-sustaining reaction and to recover heat energy generated by the reaction without producing unacceptable amounts of highly volatile by-products.

Another object is to provide continuously operable ignition means within a fluidized bed reactor for burning polymeric particles. The ignition means comprises a point source of heat maintained at an elevated temperature above that necessary to ignite the volatile constituents in the reactor. The process of continuously igniting the reaction while the reactor bed is in a fluidized state prevents the build-up of any appreciable amount of volatile material and promotes steady burning of any available polymer fuel.

BRIEF SUMMARY

These and other objects may be accomplished as follows. In a preferred practice of the invention, a polymer containing waste material such as dried paint sludge is continuously delivered to a fluidized bed reactor in particulate form. The reactor comprises a chamber in which a bed of inert refractory particles is continuously agitated by hot gases admitted through the bottom of the reactor to form a fluidized bed. The bed is initially heated to a temperature above the degradation temperature of the polymer particles.

Once disposed in the bed, the polymer particles aggregate with the refractory particles. The flow of fluidizing gas is regulated to assure that the aggregate particles are suspended and agitated within the bed. The rates of introduction of polymer waste and oxygen and the removal of heat during incineration are regulated to operate the reactor under substantially steady state conditions.

The subject invention relates specifically to the use of a point ignition source within a fluidized bed for burning polymers. The source may be, e.g., a glow plug of the type used in Diesel engines. The ignition source is maintained at a temperature above the flash point or ignition temperature of the volatile constituents in the reactor. It constantly ignites all volatile constituents immediately adjacent to it. These burning constituents are then instantaneously carried through the rest of the reaction chamber by the fluidizing motion. Thus, use of a point ignition source prevents any appreciable build-up of volatiles within the reactor making its initial and sustained operation both safe and efficient. The ignition source also tends to forestall auto-extinction of a going reaction should the temperature of the fluidized bed fall to a temperature approaching the minimum required to sustain combustion.

The reaction products of burned polymer scrap generally consists of hot gases and small particulates. These may be collected by such conventional means as electronic precipitation, cyclone separation and spray condensation.

I have found that burning highly pigmented automotive acrylic paint sludge in a reactor equipped with an ignition source in accordance with the invention reduces its bulk by approximately 10:1 and generates approximately 2500 kilo-calories of heat per pound of dry sludge. Much of the residue is non-combustible pigment recovered primarily in the form of metal oxides. Accordingly, the disposal of polymeric waste in a fluidized bed by the practice of my invention realizes substantial cost savings over solid waste disposal and generates useful heat energy in a safe and easily controlled burning reaction.

DETAILED DESCRIPTION

My invention will be better understood in view of the Figures and the detailed description which follows.

In a preferred practice of the invention, waste material made up at least in part of a meltable thermoplastic polymer is burned in a fluidized bed reactor to reduce its bulk and recover heat energy. While the invention relates specifically to processing polymers which would otherwise melt and clog conventional incinerators and fluidized bed reactors, the subject apparatus could be used to process other more easily handled materials such as thermosetting polymers, natural organic matter or carbon based fuels.

The subject method is particularly adapted to burning paint sludge. Paint sludge is the residue formed by the agglomeration of water or solvent based paint overspray in cascade spray booths. The sludge is generally saturated with water as formed, but is dehydrated, compressed and crushed to particles of varying sizes before its introduction into the subject fluidized bed reactors, equipped with point ignition sources. I have found that the use of powdered sludge (less than 2 mm particle diameter) alone may cause too rapid an exothermic reaction. On the other hand, when all larger sized particles are introduced (greater than 5 mm particle diameter), the induction time to a self-sustaining reaction may take several minutes. Use of paint sludge crushed to yield a cross section of particle sizes in the range of from about 1 mm to 10 mm provides for smooth and instantaneous burning in a suitable fluidized bed reactor. Accordingly, it is preferred to prepare thermoplastic waste by comminuting it to particles of mixed sizes prior to burning or pyrolysis in accordance with the method and means claimed herein. The maximum desirable particle size would be a function of the size and operating parameters of the reactor used, and would be readily determinable by one skilled in the art.

Automotive paint finishes are generally comprised, at least in part, of thermoplastic acrylic resin. Acrylic resins may be thermally degraded by two reaction mechanisms. First, they may be heated to a high temperature in the absence of oxygen. This process causes pyrolysis of the polymer. In pyrolysis, the polymerized acrylates are broken up yielding a substantial portion of methyl-methacrylate monomer, other short chain carbon constituents and heat. The other relevant reaction mechanism for acrylate degradation is combustion in the presence of oxygen, also referred to herein as incineration or burning. It is believed that in the subject point source ignited burning process, pyrolysis first takes place and thereafter the pyrolysis products burn with available oxygen to yield reaction products including carbon dioxide, water and heat.

Figure 1:
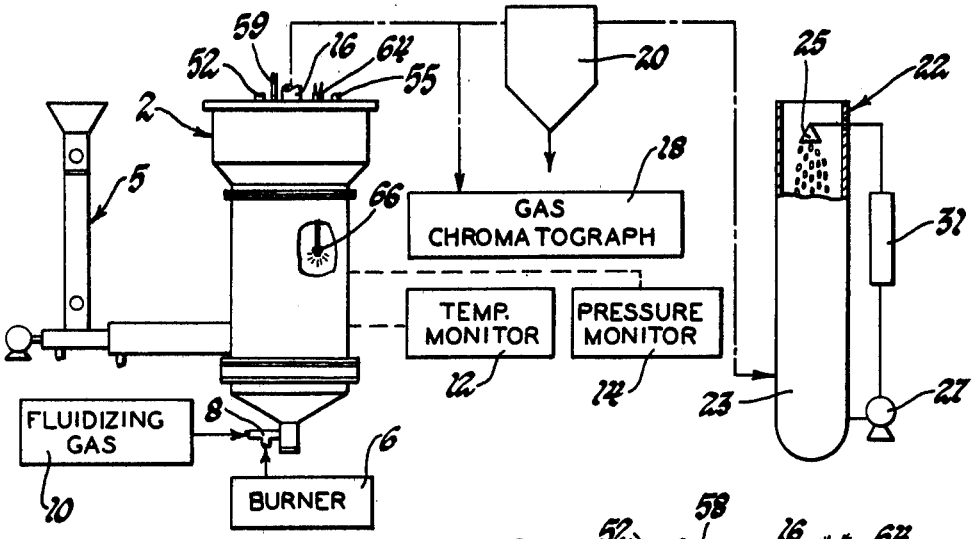
FIG. 1 is a schematic diagram of a fluidized bed reactor system for pyrolyzing or burning particulate thermoplastic materials.

FIG. 1 is a schematic representation of a system particularly adapted for burning ground thermoplastic acrylic paint sludge, one of the most difficult polymer waste disposal problems. At the heart of the system is a fluidized bed reactor 2 in which a point ignition source is located. The reactor itself is shown in greater detail at FIG. 2. Particulate thermoplastic waste is introduced at a location near the bottom of the reactor by means of a feed mechanism 5 shown in greater detail at FIG. 5.

Prior to introducing thermoplastic waste particles into reactor 2, reaction chamber 4 (FIG. 2) and particle bed 7 are heated to a temperature sufficient to initiate the desired burning reaction. Heating is initially accomplished by means of gas burner 6. Hot gases from burner 6 are directed through a branched pipe fitting 8 near the bottom of reactor 2. A pressurized source 10 of a fluidizing gas is also provided. The fluidizing gas is also admitted through fitting 8, as necessary, to cause agitation and fluidization of the particle bed 7 within reactor 2. Bed 7 is shown at rest in FIG. 2. Temperature monitor 12 and pressure monitor 14 are connected to several probes in the reactor walls. The power supply (not shown) connected to electrical connections 63 of point ignition source 66 is activated, heating it to a temperature well above the ignition temperature of the scrap polymer. The monitors are provided to closely monitor conditions within reaction chamber 4 so that operating conditions may be controlled to achieve peak efficiency.

The burning reaction of thermoplastic waste in reactor 2 generally produces particulate and gaseous products. Some solid waste products are retained and carried in the fluidized bed during its operation. These are removed from the bottom of the reactor after a run. Gaseous products and fine particulates are continuously exhausted through an exit port 16 located at the top of reactor 2 while it operates. The composition of these products is determined by means of gas chromatograph 18 which analyzes samples intermittently withdrawn from reactor exhaust. Particulates are collected in cyclone separator 20. Very fine particulates and vapors are collected downstream of separator 20 in spray condenser 22.

Figure 2:
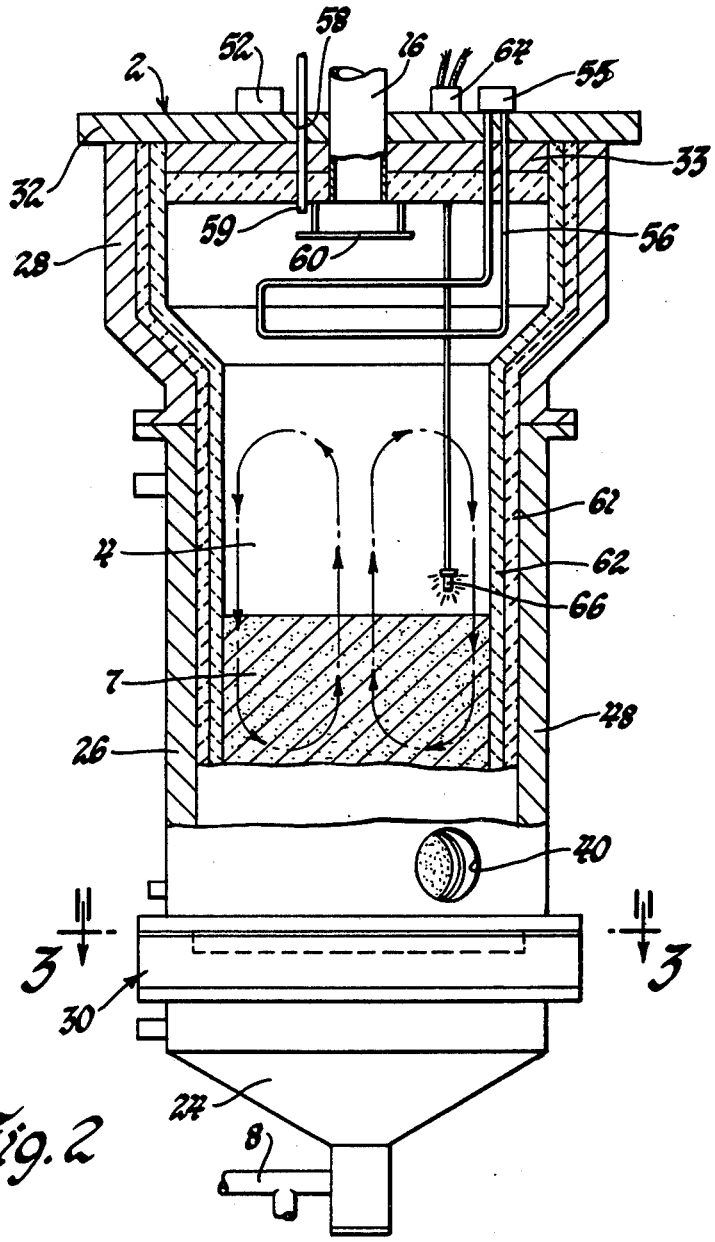
FIG. 2 is a sectional view of a fluidized bed reactor of the type suitable for the practice of the invention showing the presence and placement of a point ignition source in accordance with the invention.

Referring now to FIG. 2, a reactor 2 in which paint sludge was burned as described and claimed herein is schematically shown in some detail. Reactor 2 is made up of three stacked sections: a plenum or wind box 24 at the bottom, reaction chamber housing 26 above plenum 24, and flue 28 above housing 26. A gas distributor or diffuser plate 30 is interposed between plenum 24 and housing 26, and cover 32 overlays flue section 28. The sections are secured together by means of bolts and gasket materials (not shown) to form airtight seals between the members.

Fluid flow in reactor 2 is generally upwards from bottom to top. Fluidizing and heating gases are introduced through fitting 8, distributed evenly through plenum 24 and then forced through distributor plate 30 into reaction chamber 4. Plenum 24 is shaped like an inverted funnel, opening up towards gas distributor plate 30. The flow rate of the gas through plate 30 is regulated to control the fluidization of bed 7.

Generally, 10 kilograms of 80 mesh white silica sand was introduced into chamber 4 to form particle bed 7 before each run. While sand is a preferred bed agent, other materials which would not interfere with polymer burning would also be suitable. For example, crushed limestone or even particles catalytic to the reaction could be used.

Figure 3:
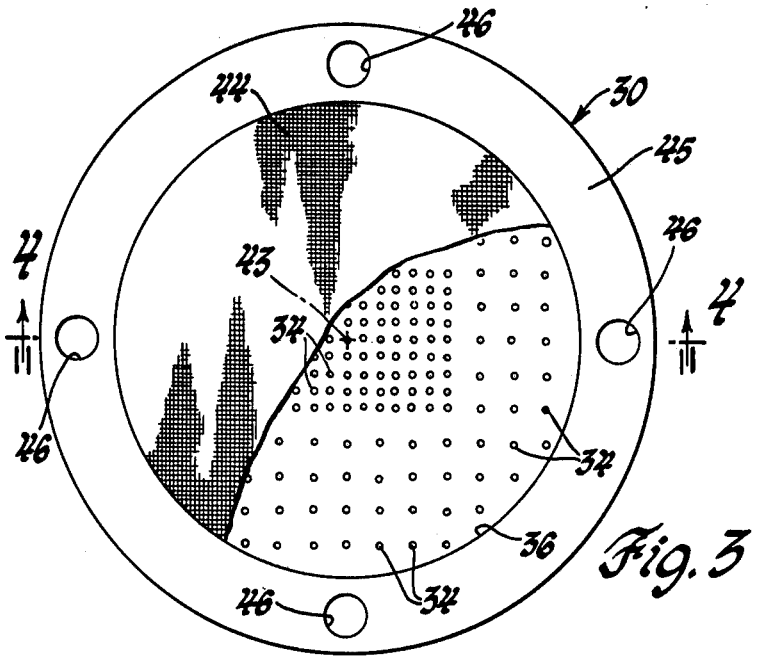
FIG. 3 is a broken away plan view of a distributor plate and screen through which pressurized gas is admitted into a fluidized bed reaction chamber.
Figure 4:
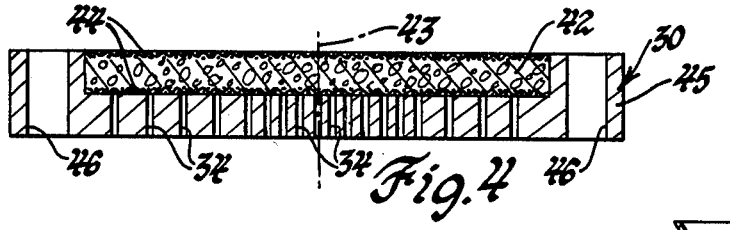
FIG. 4 is a sectional side view of the distributor plate and screen of FIG. 3.

Referring now to FIGS. 3 and 4, distributor plate 30, machined from 310 stainless steel, is 350 mm in diameter, 10.8 mm thick at the center 43 and 15.9 mm thick at flange 45. Holes 34 are provided in plate 30 to distribute air from plenum 24 into reaction chamber 4. Eight hundred and eighty one (881) holes, 1.5 mm in diameter each, were drilled through plate 30 in a pattern like that shown generally at FIG. 3. Substantially more holes 34 were drilled near the center 43 of plate 30 than near flange 45. Bolt holes 46 are provided in flange 45 for fastening housing 26, plate 30 and plenum 24 together.

Fluidization of refractory particle bed 7 in chamber 4 is caused by the flow of gas through holes 34. The arrangement of holes determines the path of particle flow in reaction chamber 4. The array of holes 34 in plate 30 of FIGS. 3 and 4 causes the particles to travel in a toroidal path from along the bottom of the bed towards the center, up the center of the toroid, across the top and then down the wall of the reactor back towards the bottom as indicated with broken lines at FIG. 2. Because of the cyclical motion of the particles of bed 7, when thermoplastic feed stock is introduced through inlet 40 in the reactor housing section 26, it is immediately carried to the bottom. Thereafter, the feed stock joins the torodial flow path of the refractory particles.

Thus, the use of a distributor plate as described assures that waste particles are immediately dispersed within the bed and continuously circulated therethrough. Use of the subject point ignition source 66 assures that a portion of the particles is always being ignited. Then, these burning particles are instantaneously brought into contact with other unignited particles in the bed. This not only promotes initial and sustained burning within the reactor, but also prevents the build-up of dangerous amounts of pyrolysis products. Use of the point ignition source also prevents the development of cold spots that can quench the degradation reaction and cause clogging of the reactor, especially when thermoplastics are burned.

Again, referring to FIG. 4, a disc 42 of metallic foam (80% Co, 10% Ni, 10% Cr alloy) is disposed in a circular groove in the top of distributor plate 30. Foam disc 42 mediates the flow of pressurized gas through holes 34 without affecting the flow path of particles in the fluidized bed. It also acts as a fail safe to prevent any fugitive melted plastic or particulate of bed 7 from clogging holes 34. Because this metal foam is fragile, it is sandwiched between two layers 44 of fine mesh stainless steel wire cloth.

Referring again to FIG. 2, outer wall 48 of chamber section 26 is a tubular stainless steel structure having a right circular cylindrical shape. The chamber is 533 mm high with an outside diameter of 280 mm and an inside diameter of 203 mm. Six heating coils (not shown) are provided around outer wall 48 for initially elevating its temperature to prevent substantial heat loss from reaction chamber 4. During operation, the fluidized bed is substantially confined to reactor section 26.

Flue section 28 has an outer wall 29 made of stainless steel which is positioned above reaction chamber section 26. It tapers outwardly from the size of housing 26 to a larger outside diameter of 432 mm. Flue 28 is 300 mm high. On the top of flue section 28, a 13 mm thick cover plate 32 is provided with a positioning insert disc 33 and insulating layer 35.

Cover 32 has several ports therethrough, the largest of these (in diameter) is located in the center as an outlet 16 for gaseous and fine particulate reaction products. Covered access door 52 was provided for introducing particles to refractory bed 7. A sealed portal 55 was provided for accommodating heat exchanger 56. A small port 58 was provided for gas sampling line 59 to the gas chromatograph.

Sealed port 64 was provided for electrical connections 63 to glow plug 66. Glow plug 66 was situated inside the reactor 4 a few centimeters above static bed 7. Glow plugs are well known for use in localized heating applications. See, for example, U.S. Pat. No. 4,112,577 assigned to the assignee hereof. Glow plugs are generally known in the electrical heater art to comprise a closed end tubular protective metal sheath surrounding an axially extending heating element. The element is electrically connected with the closed end of the sheath and also connects with an electrode extending from the sheath open end. The remainder of the sheath interior is packed with a suitable insulating material such as magnesium oxide (MgO). However, the structure of a glow plug, or any other element capable of providing a point source of heat in a fluidized bed reactor, is not cogent to the subject invention. During reactor operation, the glow plug was connected to a 12 volt 5 amp power source. Glow plug 66 is of the type used to promote combustion in diesel engine cylinders, particularly on cold starts. Glow plug 66 serves as a point ignition source for polymer burning reactions carried out in the fluidized bed. While a glow plug is a preferred ignition source, any other ignition source such as a spark plug, a resistance element, a dielectric spark ignitor, a high temperature flame, etc. may be used. Any such ignition source must, however, operate at a temperature above the combustion temperature of the material to be burned in the reactor.

The point ignition source (glow plug 66) of the several Figures operates to continuously ignite at least the portion of scrap material adjacent to it. This ignited material is then rapidly carried throughout the reactor by the action of the fluidized bed.

Thus, inclusion of a point ignition source serves to prevent the accumulation of combustible and potentially explosive gases in the reactor. It further serves to prevent auto-extinction of a burning reaction, particularly if the reactor temperature is allowed to fall to a temperature close to the minimum temperature at which the burning reaction is self-sustaining. The ignition source also initiates the polymer burning reaction in a fluidized bed reactor at a temperature substantially lower than the auto-ignition temperature of the polymer constituents therein.

A baffle 60 is disposed beneath outlet 16 of flue 28 to prevent the passage of large particles from the reactor. Housing 26 and flue 28 are lined with 25 mm thick layer 62 of cast and dried refractory. A refractory blanket 61 was inserted between housing outer wall 48, flue wall 29 and refractory line 62 for further insulation value. Obviously, the amount of heat recoverable from exothermic burning of polymers is a function of heat loss from the reactor. Therefore, improved insulation can improve heat recovery.

The temperature of the fluidized bed reactor and heated sampling line were measured with Chromel-Alumel thermocouples. The temperatures were displayed on a 0°–2000° F. range Leads and Northrup digital readout thermometer. Thermocouple ports (not shown) were provided in the reactor walls at vertical separation distances of about 150 mm.

Figure 5:
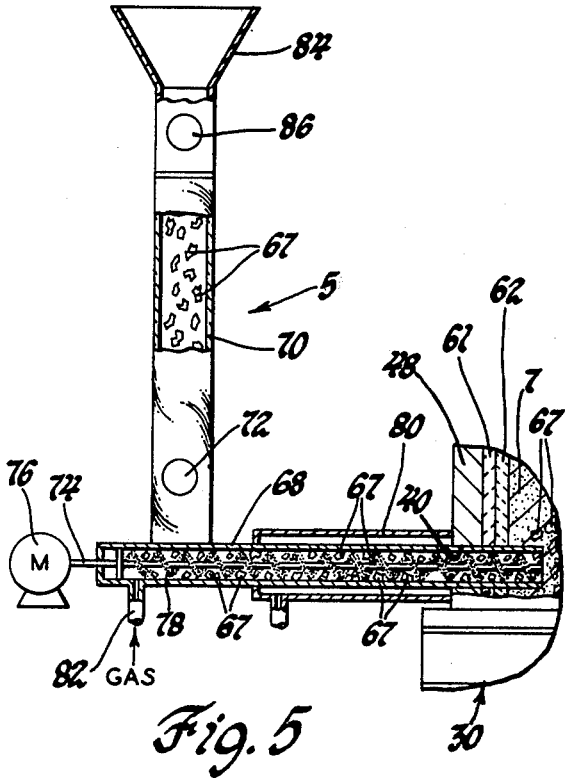
FIG. 5 is a sectional view of a brush screw feeder suitable for introducing thermoplastic materials into an operating fluidized bed reactor.

Referring now to FIG. 5, a feeder substantially like that which I employed for delivering thermoplastic particles to be burned or pyrolyzed in the fluidized bed reactor is shown in more detail. The feeder barrel 68 for thermoplastic particles 67 enters the reaction chamber 4 through a 76 mm flanged opening 40 located about 25 mm above gas distribution plate 30. Feeder barrel 68 extends about 25 mm through opening 40 in wall 48 of housing 26 and into the fluidized bed. Prior to delivery, waste particles 67 are retained in an 800 mm high, 75 mm diameter acrylic hopper 70. This allowed visual metering of the particle flow through feed valve 72 into feed barrel 68. Particles are introduced into hopper 70 through chute 84 with valve 86 open. Valve 86 is closed while particles 67 are fed to the reactor.

Particles 67 are conveyed through feed barrel 68 by rotation of shaft 74 driven by a motor 76, shaft 74 carrying a plurality of helically mounted stainless steel bristles 78. Unlike a rigid screw feeder, the bristles bend and slip by small obstructions in the barrel wall reducing torque on shaft 74 and abrasion between the brush flights and the feeder barrel. Water jacket 80 is provided around barrel 68 to cool it and help prevent any polymer from melting before it reaches the fluidized bed. An air inlet 82 is located at the end of feeder barrel 68 remote from reactor 2. The air is admitted at a rate to keep the feed stock particles 67 mobile and unmelted while in barrel 68. The air pressure in the feed tube must be greater than reactor pressure to prevent backflow of hot reactor gases. If the particles are to be degraded by hydrolysis, it is preferable to use an inert carrier gas such as nitrogen in the feed tube 68.

Most of the fine particulate pyrolysis and incineration products (about 10 mesh or smaller) was collected in a cyclone separator about 120 mm in diameter and 220 mm high. Referring back to FIG. 1, exhaust gases from cyclone separator 20 and very fine particulates were trapped in a conventional spray condenser 22. The condenser column 23 is 152 cm long and 15 cm in diameter. Water from sprayer 25 washes the incoming gases. Condensation from near the bottom of column 23 is recirculated to sprayer 25 by pump 27 through heat exchanger 31.

Exhaust gas was intermittently sampled through tube 58 and analyzed by a Hewlett-Packard 540A Reporting® gas chromatograph. The chromatograph was programmed for automatic analysis of volatile products and output of the results. The Hewlett-Packard chromatograph has two 10 ft. by ⅛" columns: one 5% Dexil 300 on 60/80 mesh Chromosorb-W and one 10% Dexil 300 on 80/100 mesh Chromosorb-W. Line 58 from reactor 2 and the chromatograph were heated. A vacuum was drawn on line 58 to withdraw gaseous products from the reactor to the chromatograph. Consequently, the chromatograph was able to analyze the gaseous products "on line" according to a preset operating time sequence.

The general procedure for operating the reactor described above and diagrammed in FIG. 1 is as follows. First, a suitable amount of refractory particles is charged into reaction chamber 4 to form a bed 7. These particles do not degrade at reactor operating temperatures nor do they interfere with the degradation reactions. The scrap 67 to be processed is disposed in hopper 70. All the temperature and pressure signal devices, cyclone separator 20, and spray condenser 22 are activated and ignition source glow plug 66 is turned on. The gas chromatograph system 18 is activated for on-line analysis of exhaust. Cooling water is run through feeder band jacket 80.

Thereafter, reactor 2 is heated to a temperature selected for a run by burner 6 and the six band heaters (not shown) around housing 26 are turned on.

Fluidizing gas is introduced into reactor 2 at a rate to maintain good fluidization of particle bed 7. Enough air is introduced into the bed through fitting 8 to support complete combustion of the scrap. The system is then allowed to come to equilibrium which is characterized by a constant temperature within the bed.

At this point, scrap material is continuously introduced into the hot fluidized bed reactor via feeder mechanism 5. Once combustion is well under way, burner 6 and the band heaters are turned off. The glow plug, however, is left on to prevent any build-up of unburned hydrolysis particles. Once the self sustaining reaction is achieved, the intensity of combustion is controlled by varying the feed rate of the scrap material and the air flow rate in the reactor. Excess heat is removed through heat exchanger 56. Reactor 2 is shut down by reversing the process set forth above.

In general, the heat liberated by a burning reaction in the fluidized bed must be greater than or at least equal to the heat lost from the system by, e.g., discharge of reaction products and radiation from the reactor. By experimentation I have determined that with adequate reactor insulation, bed temperature and air velocity therein are two variables which have significant effect on the steady-state operation of the subject fluidized bed reactors.

Figure 6:
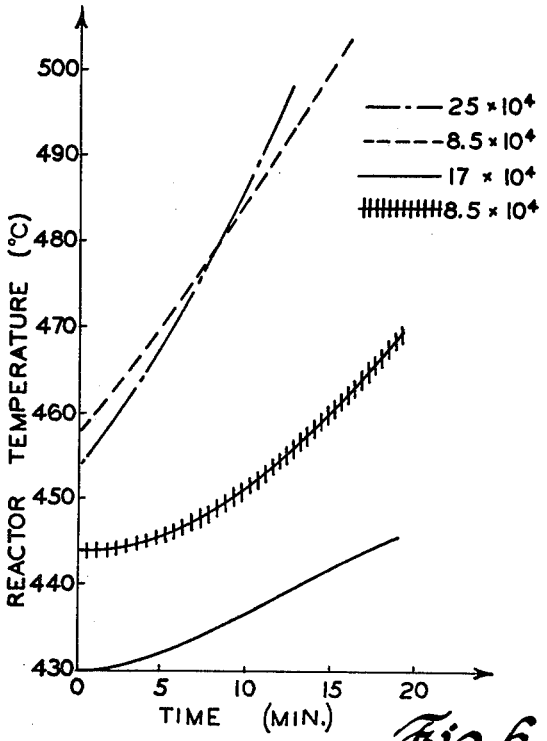
FIG. 6 is a plot of reactor temperature as a function of time for the incineration of a kilogram of acrylic paint sludge at several different fluidizing air flow rates.

Referring to FIG. 6, Reactor Temperature versus Time is plotted for the incineration of one kilogram of automotive acrylic lacquer sludge at several different fluidizing air velocities. While there is considerable variation in the composition of such sludge, that used for my experiments had an approximate weight assay of about 66.5% acrylic resin based on poly(methyl methacrylate), 32 percent pigments (primarily metal oxides), 1 percent aluminum and 0.5% coagulants. The air flow rates of FIG. 6 are listed adjacent corresponding line legends and are in units of $cm^3$/min Air.

Looking at the curve for an air flow rate of $17\times10^4$ $cm^3$/min at room temperature, it is clear that at too low an initial reactor temperature (here about 430° C.) that even a relatively high air flow rate will not promote a high rate of incineration of the paint sludge.

However, above a critical temperature of about 440° C., and in the presence of the continuous ignition source, even a relatively low air flow rate will sustain burning of acrylic paint sludge. This is indicated by a significant elevation in reactor temperature with time as plotted in FIG. 6. Thus, at an air velocity of 8.5 $cm^3$/min at an initial reactor temperature of about 443° C., a sludge burning reaction is promoted and sustained.

The plot of FIG. 6 also indicates that at an initial temperature above about 450° C., reactor temperature rises relatively rapidly. This rise is about the same for air inlet flow rate of both $8.5\times10^4$ $cm^3$/min and $25\times10^4$ $cm^3$/min. This suggests that if the burning reaction within a fluidized bed reactor has a sufficient supply of oxygen and is operating above the critical ignition temperature for the feedstock, the effect of air flow rate on the reaction is not significant.

For burning one kilogram of the automotive lacquer sludge, it is clear that an initial temperature of 430° C. is somewhat low. Similarly, a starting temperature of about 445° C. does not initially promote rapid temperature rise in a reactor. However, an initial reactor temperature of about 453° C. and higher promotes rapid reactor temperature rise, indicative of efficient burning of the paint sludge. Such critical temperatures for other polymeric feedstocks can readily be determined by one skilled in the art and the fluidized bed reactor operated accordingly.

My invention is further defined in terms of the following Example.

EXAMPLE

A series of tests was conducted to investigate the self-sustaining incineration of automotive acrylic lacquer, solventborne acrylic enamel and waterborne acrylic paint. All contained about 75 weight percent poly(methyl methacrylate) with the balance being inorganic pigments and traces of other organic constituents. One kilogram of sludge predried at about 95° C. was burned per run.

The apparatus used was that described above including the point ignition source in a fluidized bed reactor with specially adapted diffuser plate, the brush screw feeder, the exhaust treatment system, the measurement devices and all other peripheral devices. Incineration was generally carried out at one atmosphere gage pressure at a steady state reactor temperature of about 1000° C. Fluidizing air velocity through the diffuser plate was maintained at approximately 340 liters per minute. These conditions were selected to insure an adequate supply of oxygen for combustion (approximately 17% excess oxygen). The glow plug in the reactor chamber was operated continuously to assure constant ignition of the thermoplastic sludge.

More than 98.4 weight percent of the organics in the paint sludge burned at a rate of approximately 38.6 grams per minute. The sludge was introduced through the feeder tube at the same rate. The total energy released during combustion of each 2.28 kg of sludge was calculated to be approximately 13,000 kilocalories. About 0.6 kg of noncombustible solids remained in the bed material as residue. Spectrographic analysis of the residue, reported in Table I indicated that the residue consisted mostly of inorganic metal oxides. Most of the solid reaction products were removed from the exhaust gases of the reactor in the cyclone separator and spray condenser.

TABLE I

| Spectrographic Analysis of Bed Residue* Element in Each Type of Paint Sludge (%) | | | |
|---|---|---|---|
| Element | Acrylic Lacquer | Solventborne Enamel | Waterborne Enamel |
| Ti | 5 | 4 | 4 |
| Fe | 4 | 4 | 4 |
| Al | 10 | 10 | 10 |
| Si | 10 | 10 | 10 |

TABLE I-continued

| Spectrographic Analysis of Bed Residue* Element in Each Type of Paint Sludge (%) | | | |
|---|---|---|---|
| Element | Acrylic Lacquer | Solventborne Enamel | Waterborne Enamel |
| Mg | 0.1 | 0.1 | 3 |
| Pb | 1 | 5 | 0.05 |
| Ni | 0.05 | 0.1 | 0.02 |
| Cu | 0.1 | 0.1 | 0.1 |
| Ca | 0.1 | 0.5 | 0.3 |
| Cr | 0.1 | 0.5 | 0.02 |
| Na | 0.1 | 0.5 | 0.1 |

*These are semi-quantitative estimates, reported in percent of sample. The actual values are expected to be within one-third to three times the reported values.

On the basis of these runs, I have found that incineration of dried paint sludge in accordance with this invention achieves the following desirable results. First, the volume of the paint sludge is reduced from about one tenth to one twentieth of its initial volume depending on initial water and pigment content of the sludge. A substantial amount of heat, approximately 6,000 kilocalories per kilogram, is generated by the combustion reaction and depending on the heat losses from the reactor, a substantial amount of this energy can be recovered for useful purposes. Moreover, the sludge undergoes almost complete oxidation of combustible components, and the noncombustible residue is relatively easy to dispose of.

In summary, paint sludge or other polymeric scrap materials, including thermoplastics, can be effectively incinerated in a fluidized bed reactor incorporating a point ignition source. Virtually all the organics burn with only a relatively small volume of inorganic residue remaining. Excess heat can be recovered for useful purposes.

While my invention has been described in terms of specific embodiments thereof, clearly other forms may be readily adapted by one skilled in the art. Accordingly, my invention is to be limited only by the following claims.

The embodiments of the invention in which an exclusive property or privilege is claimed are defined as follows:

1. In a fluidized bed reactor suitable for burning paint sludge having an acrylic polymer constituent the improvement comprising a point source of heat maintained at a temperature above the ignition temperature of the polymer constituent, said source being located in the reactor such that it is immersed in the fluidized bed, the presence of said heat source serving to initially and continuously ignite the acrylic paint component of the sludge and prevent the accumulation of explosive amounts of reaction products within the reactor wherein said point source of heat is an electrically heated glow plug.

2. A method of burning thermoplastic scrap material comprising introducing particles of said thermoplastic scrap material into a heated fluidized bed of refractory particles such that the thermoplastic particles coalesce with said refractory particles;

continuously igniting said coalesced particles in said bed by means of an electrically heated glow plug located therein, said source being at a temperature above the ignition reaction temperature of the scrap particles; and adding thermoplastic scrap particles to the reactor while withdrawing reaction products and heat at relative rates such that the reactor operates continuously and uniformly at a desired elevated temperature.

3. A fluidized bed reactor for burning thermoplastic polymeric scrap material in a self-sustaining combustion reaction to reduce its bulk and recover heat energy therefrom comprising a chamber for retaining a fluidized bed of refractory particles and said scrap material;

means for initially heating the bed to the combustion temperature of the scrap material;

means to introduce air into said chamber at controlled rates and locations to fluidize the particle bed and provide an amount of oxygen adequate to sustain scrap combustion;

means to introduce the scrap material to the reaction chamber in substantially unmelted particulate form at a controlled rate;

ignition means comprising an electrically heated glow plug at or above the ignition temperature of the thermoplastic scrap, said means being located within the reaction chamber to contact the fluidized scrap material and promote continual ignition and uniform burning within the reactor;

means for removing excess heat generated by the scrap burning reaction; and means for collecting the solid and gaseous reaction products of the scrap combustion.

4. In a fluidized bed reactor suitable for burning thermoplastic scrap material, an electrically heated glow plug located within the fluidized bed and operating at a temperature above the ignition temperature of the material to be burned therein, said glow plug being operative in the reactor at a suitable elevated reactor temperature to continuously ignite at least the portion of the material immediately adjacent to it, said ignited portion being rapidly carried throughout the bed by the motion of the fluidized particles to sustain uniform and continuous burning of the material in the reactor and to prevent the accumulation of combustible gases.

* * * * *